US008777374B2

(12) United States Patent
Naruse et al.

(10) Patent No.: US 8,777,374 B2
(45) Date of Patent: Jul. 15, 2014

(54) IMAGE FORMING APPARATUS

(75) Inventors: Shinichiro Naruse, Fujisawa (JP); Ichiro Komuro, Yokohama (JP); Soichi Saiga, Machida (JP)

(73) Assignee: Ricoh Company, Ltd., Tokyo (JP)

( * ) Notice: Subject to any disclaimer, the term of this patent is extended or adjusted under 35 U.S.C. 154(b) by 549 days.

(21) Appl. No.: 12/780,520

(22) Filed: May 14, 2010

(65) Prior Publication Data

US 2010/0295897 A1 Nov. 25, 2010

(30) Foreign Application Priority Data

May 20, 2009 (JP) ..... 2009-121956
Mar. 5, 2010 (JP) ..... 2010-049033

(51) Int. Cl.
*B41J 2/165* (2006.01)

(52) U.S. Cl.
USPC ..... 347/37

(58) Field of Classification Search
None
See application file for complete search history.

(56) References Cited

U.S. PATENT DOCUMENTS

| | | | | |
|---|---|---|---|---|
| 5,166,708 | A * | 11/1992 | Hirano et al. | 347/24 |
| 5,949,443 | A * | 9/1999 | Yamamoto et al. | 347/3 |
| 7,481,365 | B2 * | 1/2009 | Liu et al. | 235/380 |
| 7,578,572 | B2 | 8/2009 | Naruse | |
| 7,628,556 | B2 | 12/2009 | Naruse | |
| 2009/0211469 | A1 * | 8/2009 | Kalmthout et al. | 101/93.47 |

FOREIGN PATENT DOCUMENTS

| | | |
|---|---|---|
| JP | 9-109423 | 4/1997 |
| JP | 9-240097 | 9/1997 |
| JP | 2785031 | 5/1998 |
| JP | 2008-229917 | 10/2008 |

* cited by examiner

*Primary Examiner* — Alejandro Valencia
(74) *Attorney, Agent, or Firm* — Cooper & Dunham LLP

(57) ABSTRACT

An image forming apparatus including a main carriage to move and scan in a main scanning direction, a sub-carriage connectable to the main carriage to move and scan in the main scanning direction together with the main carriage, a positioning guide provided on one of the main carriage and the sub-carriage, and a position detector provided on the other one of the main carriage and the sub-carriage. The position detector reads the positioning guide as the main carriage and the sub-carriage connect to each other to detect relative positions of the main carriage and the sub-carriage.

13 Claims, 9 Drawing Sheets

IMAGE FORMING APPARATUS

BACKGROUND

1. Technical Field

This disclosure relates generally to an image forming apparatus, and more particularly to an image forming apparatus including multiple carriages each having a recording head in which positions of the carriages are reliably controlled.

2. Description of the Background

Related-art image forming apparatuses such as copiers, printers, facsimile machines, and multifunction devices having two or more of copying, printing, and facsimile functions include inkjet-type image forming apparatuses employing a liquid discharge recording method. Such inkjet-type image forming apparatuses include a recording head composed of a liquid-droplet discharge head that discharges droplets of a recording liquid such as ink. The droplets of the recording liquid attach to a recording medium such as a sheet of paper or the like to form an image on the sheet while the sheet is conveyed.

In a full-color inkjet-type image forming apparatus capable of forming full-color images, a carriage having a recording head composed of a liquid discharge head that discharges ink droplets of four or more colors, that is, for example, black (K), yellow (Y), cyan (C), and magenta (M), or a recording head having nozzle arrays, scans to form full-color images on a sheet. However, when monochrome images are mainly formed by such a full-color inkjet-type image forming apparatus, the recording head for discharging color ink droplets can dry out, causing nozzles of the recording head to clog. Although color ink droplets that are not used for image formation are discharged from the recording head to clear the recording head for the purpose of preventing clogging of the nozzles, such discharge is a waste of color ink. Consequently, even monochrome images may not be formed during monochrome image formation because the apparatus runs out of color ink.

Published Unexamined Japanese Patent Application No. H02-001327 (hereinafter referred to as JP-H02-001327-A) discloses a serial printer including a first carriage having a group of recording heads for discharging color ink droplets and a second carriage having a recording head for discharging black ink droplets. During color printing, the first and second carriages are connected to each other to integrally scan and perform printing. By contrast, during monochrome printing, only the second carriage scans and performs printing operations, and the first carriage is moisturized in order to prevent the group of recording heads from drying.

In the configuration in which multiple carriages are connected to or disconnected from each other as disclosed in JP-H02-001327-A, the accuracy with which each carriage is positioned can greatly affect printing accuracy. Specifically, improper connection of the carriages or relative displacement between the carriages connected to each other due to repeated connection and disconnection of the carriages can cause a shift in printing ions of the recording heads, possibly resulting in irregular printing including uneven image density and so forth. However, how to improve positional accuracy of each carriage is not disclosed in JP-H02-001327-A.

Published Unexamined Japanese Patent Application No. H09-109423 (hereinafter referred to as JP-H09-109423-A) discloses a technique for controlling positions of multiple carriages which are connected to each other to integrally scan. Specifically, a carriage for discharging black ink droplets and a carriage for discharging color ink droplets can be selectively coupled with a scanner capable of scanning along a guide shaft through a gripper. A lock part provided to the scanner engages grip parts respectively provided to the carriages to lock the scanner and the carriages together.

In another approach, Published Unexamined Japanese Patent Application No. H09-240097 (hereinafter referred to as JP-H09-240097-A) discloses a technique for obtaining an amount to correct looseness of connection between carriages and scanner. Specifically, a carriage for discharging black ink droplets and a carriage for discharging color ink droplets are selectively coupled with the scanner through a gripper, and sensor shielding plates are respectively provided to the scanner and the carriages. The amount to correct looseness of connection between the carriages and the scanner is obtained based on the timing of the sensor shielding plates shielding an optical path of a home position sensor provided at a predetermined position of the apparatus.

However, although multiple carriages are connected to the scanner through an intermediate member such as a gripper according to the techniques disclosed in JP-H09-109423-A and JP-H09-240097-A, the intermediate member may prevent the positions of the carriages from being accurately controlled. Further, because the shielding plates are respectively provided to the carriages to detect the positions of the carriages according to the technique disclosed in JP-H09-240097-A, displacement between the carriages may not be accurately detected.

In yet another approach, a technique for correcting a printing position by accurately detecting a position to where liquid droplets are discharged (hereinafter referred to as a landing position of liquid droplets) and correcting deviation in the landing position of the liquid droplets has been disclosed in Published Unexamined Japanese Patent Application No. 2008-229917. Specifically, an image forming apparatus includes: pattern forming means for forming, on a water-repellent member, an adjusting pattern constituted as multiple independent liquid droplets discharged from a recording head; a pattern reading sensor composed of a light emitting element for emitting light to the adjusting pattern and a light receiving element for receiving regular reflection light from the adjusting pattern; calculating means for calculating an amount of deviation in the landing position of the liquid droplets based on a result detected by the pattern reading sensor, and correction amount calculating means for calculating a correction amount of timing to discharge liquid droplets based on the amount of deviation in the landing position of the liquid droplets calculated by the calculating means.

However, although the deviation in the landing position of the liquid droplets can be accurately corrected by the above-described image forming apparatus, the image forming apparatus includes only a single carriage. Therefore, a displacement between multiple carriages caused by repeated connection and disconnection of multiple carriages is not solved by the above-described image forming apparatus.

SUMMARY

In this disclosure, an image forming apparatus including multiple carriages is provided. At least one of the multiple carriages has a reference position used for controlling positions of the carriages so that displacement between the carriages caused by repeated connection and disconnection of the carriages is easily and accurately detected.

In one illustrative embodiment, an image forming apparatus includes a main carriage to move and scan in a main scanning direction, a sub-carriage connectable to the main carriage to move and scan in the main scanning direction together with the main carriage, a positioning guide provided on one of the main carriage and the sub-carriage, and a position detector provided on the other one of the main carriage and the sub-carriage. The position detector reads the positioning guide as the main carriage and the sub-carriage connect to each other to detect relative positions of the main carriage and the sub-carriage.

Additional aspects, features, and advantages of the present disclosure will be more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein like reference numerals designate identical or corresponding parts throughout the several views and wherein.

DETAILED DESCRIPTION OF THE ILLUSTRATIVE EMBODIMENTS

Figure 1:
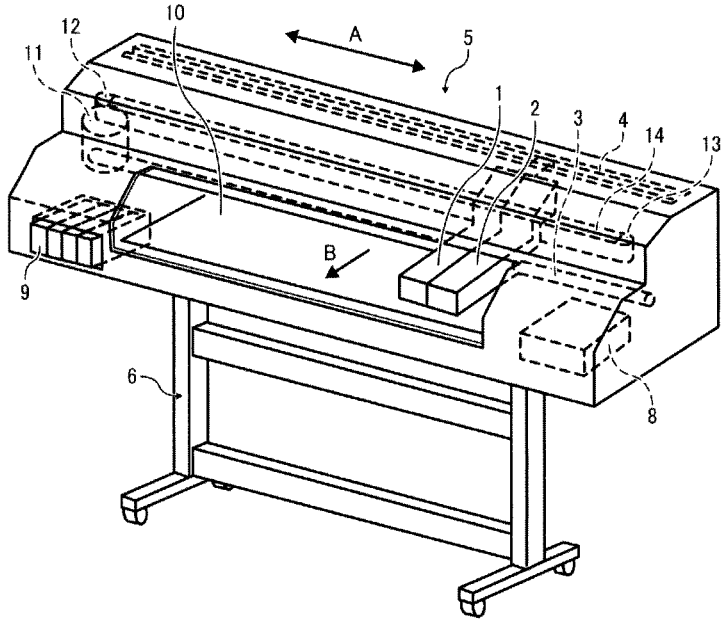
FIG. 1 is a perspective view illustrating an example of an overall configuration of an image forming apparatus according to illustrative embodiments.

In describing illustrative embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Figure 2:
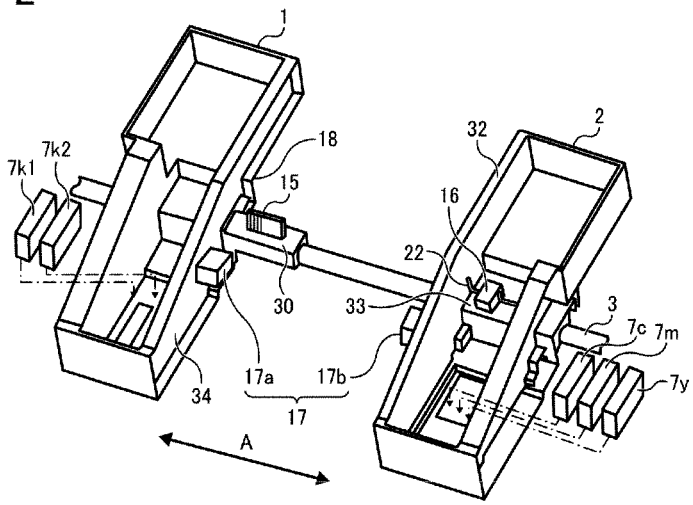
FIG. 2 is a perspective view illustrating a configuration of a main scanning unit according to a first illustrative embodiment.

A description is now given of a configuration of a serial-type inkjet recording device serving as an image forming apparatus 5 according to illustrative embodiments. FIG. 1 is a perspective view illustrating an example of an overall configuration of the image forming apparatus 5. FIG. 2 is a perspective view illustrating a configuration of a main scanning unit according to a first illustrative embodiment included in the image forming apparatus 5 illustrated in FIG. 1. A main body of the image forming apparatus 5 is supported by a support stand 6.

The image forming apparatus 5 includes a guide rod 3 and a guide rail 4, each of which is extended between internal right and left lateral plates of the image forming apparatus 5, not shown. Each of a main carriage 1 and a sub-carriage 2 is slidably held by the guide rod 3 and the guide rail 4 so as to be able to move in a direction indicated by double-headed arrow A in FIG. 1, that is, a main scanning direction of the main carriage 1 and the sub-carriage 2. The main carriage 1 and the sub-carriage 2 can be connected to each other through a joint assembly 17 shown in FIG. 2. A state in which the main carriage 1 and the sub-carriage 2 are connected to each other is hereinafter referred to as "a connected state". When not connected to the sub-carriage 2 through the joint assembly 17, the main carriage 1 alone is movable. The sub-carriage 2 is movable only when connected to the main carriage 1, and may not be held by the guide rod 3. Examples of the joint assembly 17 include, but are not limited to, well-known or new joint means such as a linking lever and an engaging pin.

The main carriage 1 includes recording heads 7*k*1 and 7*k*2 each discharging ink droplets of a color of black (K). The sub-carriage 2 includes recording heads 7*y*, 7*m*, and 7*c* respectively discharging ink droplets of colors of yellow (Y), magenta (M), and cyan (C).

In the image forming apparatus 5, only the main carriage 1 scans to perform printing operations during monochrome printing, at which time the sub-carriage 2 is in a standby state at a home position, that is, for example, at a position above a maintenance/recovery mechanism 8. Conversely, during full-color printing, the main carriage 1 is moved toward the sub-carriage 2 in the standby state positioned at the home position so that the main carriage 1 and the sub-carriage 2 are connected to each other through the joint assembly 17 to integrally scan and perform full-color printing operations. A sub-tank, not shown, for supplying ink of a corresponding color to each of the recording heads 7*k*1, 7*k*2, 7*y*, 7*m*, and 7*c* (hereinafter collectively referred to as recording heads 7 where individuation is not required) is integrally provided to each of the recording heads 7.

A main scanning mechanism that drives the main carriage 1 and the sub-carriage 2 includes a drive motor 11 provided at one end of the main body of the image forming apparatus 5 in the main scanning direction, a drive pulley 12 rotatively driven by the drive motor 11, a driven pulley 13 provided at an end opposite the one end of the main body of the image forming apparatus 5 in the main scanning direction (hereinafter referred to as the other end), and a belt member 14 serving as a drive transmission member extended between and wound around the drive pulley 12 and the driven pulley 13. The driven pulley 13 is biased away from the drive pulley 12 by a tension spring, not shown. A part of the belt member 14 is fixed to a drive source connection unit 18 serving as a belt fixing part provided on a bottom surface of the main carriage 1 to guide the main carriage 1 and the sub-carriage 2 in the main scanning direction. A description of the drive source connection unit 18 is given later.

In a printing portion of a main scanning range of the main carriage 1 and the sub-carriage 2, a sheet 10 is intermittently conveyed by a sheet feed mechanism, not shown, in a direction perpendicular to the main scanning direction of the main carriage 1 and the sub-carriage 2, that is, a direction indicated by arrow B in FIG. 1 (hereinafter referred to as a sub-scanning direction or a direction of conveyance of the sheet 10).

The maintenance/recovery mechanism 8 that performs maintenance and recovery of the recording heads 7 is provided at one end of the main scanning range of the main carriage 1 and the sub-carriage 2. A main cartridge 9 that stores ink of a specific color, that is, black, yellow, magenta, or cyan, supplied to the sub-tanks of the recording heads 7 is detachably attached to the image forming apparatus 5 below a portion exterior to the main scanning range of the main carriage 1 and the sub-carriage 2, or an end opposite to the one end of the main scanning range of the main carriage 1 and the sub-carriage 2.

Figure 1A:
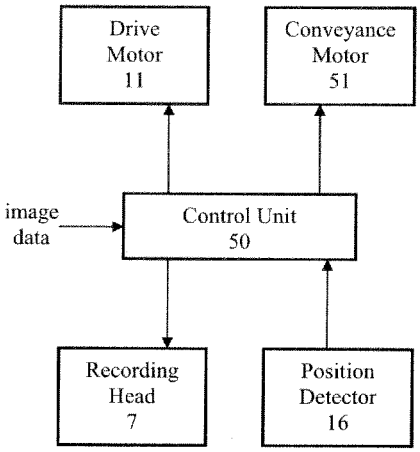
FIG. 1A shows a block diagram illustrating control by a control unit in the image forming apparatus shown in FIG. 1.

In the image forming apparatus 5, a control unit 50 (FIG. 1A) controls the drive motor 11 and a conveyance motor 51 (FIG. 1A) to move the main carriage 1 and the sub-carriage 2 in the main scanning direction while the sheet 10 is intermittently conveyed in the sub-scanning direction. Further, the control unit 50 drives the recording heads 7 respectively installed in the main carriage 1 and the sub-carriage 2 based on image data provided thereto so that the recording heads 7 respectively discharge ink droplets to form an image on the sheet 10.

A description is now given of controlling positions of the main carriage 1 and the sub-carriage 2.

In the main scanning unit, each of the main carriage 1 and the sub-carriage 2 is slidably held on the guide rod 3 in the main scanning direction. The joint assembly 17 includes joint members 17*a* and 17*b*, and the main carriage 1 and the sub-carriage 2 are connected to or disconnected from each other through the joint members 17*a* and 17*b*. Although in these embodiments the guide rod 3 is a guide member, the guide member is not limited solely thereto. Alternatively, a component that can slidably hold the main carriage 1 and the sub-carriage 2, such as a slide guide, may be used as the guide member. Further alternatively, as described above, the sub-carriage 2 need not be held by the guide rod 3. In such a case, the sub-carriage 2 may be held by another holding means, not shown, and is slid along the guide rod 3 only when connected to the main carriage 1.

The main carriage 1 includes a positioning guide 15 and the sub-carriage 2 includes a position detector 16. When the main carriage 1 and the sub-carriage 2 are in the connected state, the position detector 16 reads the positioning guide 15 to detect the position of the main carriage 1. Alternatively, the main carriage 1 may include the position detector 16 and the sub-carriage 2 may include the positioning guide 15, so that the position detector 16 reads the positioning guide 15 when the main carriage 1 and the sub-carriage 2 are in the connected state to detect the position of the sub-carriage 2. It is to be noted that "the connected state" includes not only the state in which the main carriage 1 and the sub-carriage 2 are connected to each other through the joint assembly 17 but also a state in which the main carriage 1 and the sub-carriage 2 are positioned close enough to each other so that the position detector 16 can read the positioning guide 15.

Here, the position of the main carriage 1 or the sub-carriage 2 detected by the position detector 16 means relative positions of the main carriage 1 and the sub-carriage 2. For example, when the position of the main carriage 1 is regarded as a reference, a displacement of the sub-carriage 2 can be detected. Conversely, when the position of the sub-carriage 2 is regarded as a reference, a displacement of the main carriage 1 can be detected.

The shape of the positioning guide 15 is not particularly limited as long as electrical output from the position detector 16 vary. Although including a linear scale according to illustrative embodiments, alternatively, the positioning guide 15 may have the shape of a reflective plate, a slit, a hole, or the like. Examples of the linear scale used as the positioning guide 15 include, but are not limited to, a printing linear sensor, an etching linear sensor, a glass linear sensor, and a magnetic linear sensor.

The mounting positions of each of the positioning guide 15 and the position detector 16 are not particularly limited as long as the positioning guide 15 and the position detector 16 are respectively provided to the main carriage 1 or the sub-carriage 2 so that the position detector 16 can read the positioning guide 15. For example, the positioning guide 15 is provided on a lateral surface of the main carriage 1 contacting the sub-carriage 2 when the main carriage 1 and the sub-carriage 2 are connected to each other (hereinafter referred to as a contact surface 34) such that the positioning guide 15 horizontally protrudes from the contact surface 34 of the main carriage 1 toward the sub-carriage 2. The sub-carriage 2 includes a guide part having an opening 22 that guides the positioning guide 15 so that the positioning guide 15 enters in the sub-carriage 2 when the main carriage 1 and the sub-carriage 2 are connected to each other.

Accordingly, the position detector 16 can be controlled to detect the relative positions of the main carriage 1 and the sub-carriage 2 simultaneously with the driving of the joint assembly 17 to connect the main carriage 1 and the sub-carriage 2 to each other, thereby reducing a control time to position the carriages 1 and 2. Further, a width of the main carriage 1 and the sub-carriage 2 in the main scanning direction in the contacted state can be minimized similar to a related-art configuration lacking the positioning guide 15 and the position detector 16, thereby enabling the image forming apparatus 5 to be made more compact.

In image forming apparatuses including multiple carriages, the scale of each of the multiple carriages is reduced and the width of a main scanning direction of the carriages is narrowed compared to a configuration in which a recording head for discharging black ink droplets and a recording head for discharging color ink droplets are included in a single carriage. Consequently, image forming apparatuses including multiple carriages tend to be adversely affected by horizontal and vertical vibration of the carriages during scanning of the carriages.

Therefore, it is preferable that the positioning guide 15 and the position detector 16 be provided on the guide rod 3. Accordingly, adverse effects caused by horizontal and vertical vibration of the carriages 1 and 2 can be reduced, and the relative positions of the main carriage 1 and the sub-carriage 2 can be more accurately detected.

Further, it is preferable that the positioning guide 15 be provided parallel to a longitudinal direction of the guide rod 3. Accordingly, adverse effects caused by horizontal and vertical vibration of the carriages 1 and 2 can be reduced, and the relative positions of the main carriage 1 and the sub-carriage 2 can be more accurately detected.

Figure 3A:
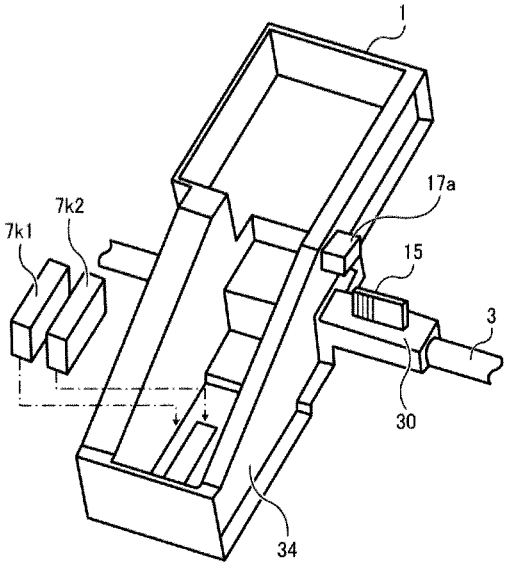
FIGS. 3A and 3B are perspective views respectively illustrating examples of a position to mount a positioning guide relative to a main carriage.
Figure 3B:
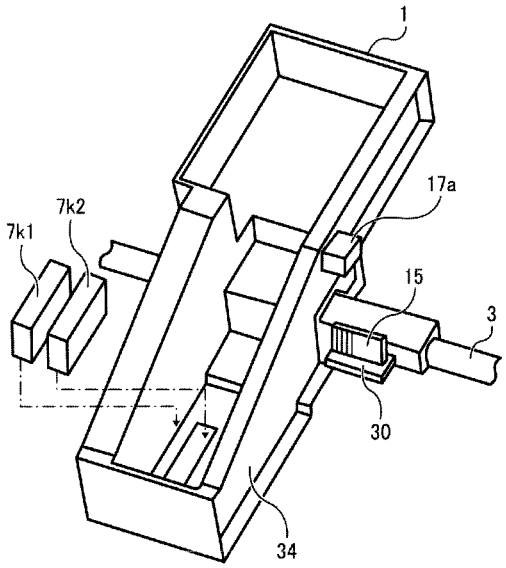

For reliable connection between the main carriage 1 and the sub-carriage 2, it is preferable that the joint assembly 17 be provided on the guide rod 3. Specifically, as illustrated in FIG. 3A, it is preferable that the joint member 17*a* be provided above the positioning guide 15. Alternatively, in order to reduce required installation space, the joint member 17*a* may be provided above the guide rod 3 and the positioning guide 15 may be provided at a position off the guide rod 3 as illustrated in FIG. 3B. Although the positioning guide 15 is positioned proximal to the recording heads 7*k*1 and 7*k*2 relative to the guide rod 3 in FIG. 3B, alternatively, the positioning guide 15 may be positioned distal to the recording heads 7*k*1 and 7*k*2 relative to the guide rod 3. Needless to say, the positions of the joint member 17*b* and the position detector 16 are changed depending on the positions of the joint member 17*a* and the positioning guide 15.

Figure 4A:
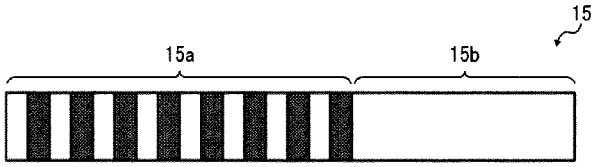
FIGS. 4A and 4B are side views respectively illustrating examples of a configuration of the positioning guide.
Figure 4B:
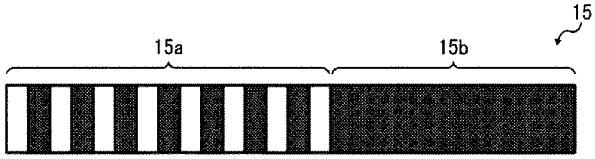

FIGS. 4A and 4B are side views respectively illustrating examples of a configuration of the positioning guide 15. The positioning guide 15 includes a first detector reading part 15*a* having multiple slits set at equal intervals that can be read by the position detector 16, to enable the position detector 16 to count the number of pulses. The positioning guide 15 further includes a second detector reading part 15*b* without slits or having slits set at intervals different from those of the first detector reading part 15*a*. It is to be noted that black portions indicate the slits in FIGS. 4A and 4B.

Specifically, the positioning guide 15 illustrated in FIG. 4A includes the first detector reading part 15*a* having the multiple slits at equal intervals and the second detector reading part 15*b* without slits. On the other hand, the positioning guide 15 illustrated in FIG. 4B includes the first detector reading part 15*a* having the multiple slits at equal intervals and the second detector reading part 15*b* having a slit with intervals different from those of the first detector reading part 15*a*.

The second detector reading part 15*b* is wider than each of white and black portions of the first detector reading part 15*a*. For example, in a case in which the positioning guide 15 having a relatively long length is cut to have only the first detector reading part 15*a*, a part of the black or white portion may inadvertently remain if the rest of the positioning guide 15 is not precisely cut off. Consequently, the position detector 16 may detect a pulse at that portion inadvertently retained. In order to prevent such false detection, a width of the second detector reading part 15*b* is increased, and adverse effects caused by inaccurate process of the positioning guide 15 can be prevented as a result. Further, the position detector 16 can detect a position to start reading when passing through a transitional position from the second detector reading part 15*b* to the first detector reading part 15*a*.

How the position detector 16 reads the positioning guide 15 is described below with reference to FIGS. 5 and 6.

Here, the positioning guide 15 illustrated in FIG. 4B is used to be read by the position detector 16. FIGS. 5 and 6 are schematic view respectively illustrating relative positions of the positioning guide 15 and the position detector 16. Specifically, FIG. 5 is a schematic view illustrating relative positions of the positioning guide 15 and the position detector 16 at a position to start detecting the number of pulses (hereinafter referred to as a pulse detection start position), and FIG. 6 is a schematic view illustrating relative positions of the positioning guide 15 and the position detector 16 when the main carriage 1 and the sub-carriage 2 are connected to each other.

Figure 5:
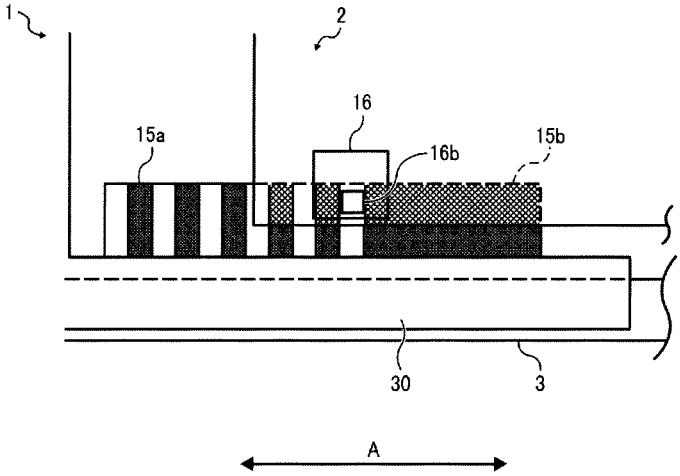
FIG. 5 is a schematic view illustrating relative positions of the positioning guide and a position detector at a pulse detection start position.

In FIG. 5, the main carriage 1 is moved from left to right toward the sub-carriage 2 in a standby state to connect to the sub-carriage 2. Specifically, FIG. 5 illustrates a state in the middle of connection of the main carriage 1 and the sub-carriage 2 in which a light receiving part 16*b* of the position detector 16 detects the first pulse of the first detector reading part 15*a*. It is to be noted that, because the position detector 16 starts detection even when the positioning guide 15 has not yet passed through the position detector 16, the first pulse of the first detector reading part 15*a* is detected by the light receiving part 16*b* of the position detector 16 in the above description.

Figure 7:
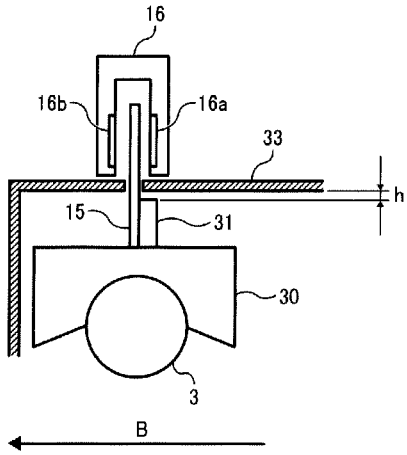
FIG. 7 is a schematic view illustrating relative positions of an upper edge of a mounting member and a bottom surface of the sub-carriage.

As illustrated in FIG. 7, the position detector 16 includes a light emitting part 16*a* and the light receiving part 16*b* with a path for the positioning guide 15 interposed therebetween. In a case in which portions of the first detector reading part 15*a* that transmit light, that is, white portions of the first detector reading part 15*a* in FIG. 4B, are positioned between the light emitting part 16*a* and the light receiving part 16*b*, or the positioning guide 15 is not positioned between the light emitting part 16*a* and the light receiving part 16*b* before the positioning guide 15 passes through the position detector 16, light emitted from the light emitting part 16*a* passes to the light receiving part 16*b* through the positioning guide 15 or directly to the light receiving part 16*b* so that the light receiving part 16*b* detects the light.

By contrast, in a case in which portions of the first and second detector reading parts 15*a* and 15*b* each shielding light, that is, black portions in the first and second detector reading parts 15*a* and 15*b* in FIG. 4B, are positioned between the light emitting part 16*a* and the light receiving part 16*b*, light emitted from the light emitting part 16*a* is blocked by the positioning guide 15 so that the light is reflected back from the positioning guide 15 without reaching the light receiving part 16*b* and is not detected by the light receiving part 16*b*.

In the case of FIG. 4A, the light receiving part 16*b* detects the light emitted from the light emitting part 16*a* during a period of time before the positioning guide 15 passes through the position detector 16 until the second detector reading part 15*b* passes through the position detector 16. By contrast, in the case of FIG. 4B, the light emitted from the light emitting part 16*a* is detected by the light receiving part 16*b* before the positioning guide 15 passes through the position detector 16, and the light emitted from the light emitting part 16*a* is not detected by the light receiving part 16*b* when the second detector reading part 15*b* passes through the position detector 16.

Figure 6:
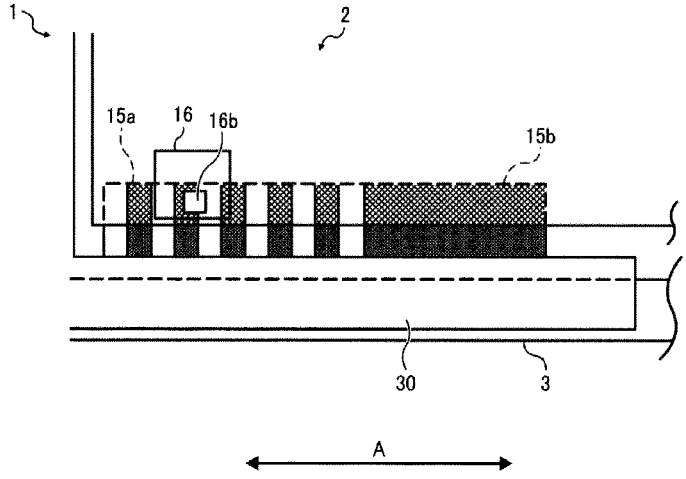
FIG. 6 is a schematic view illustrating relative positions of the positioning guide and the position detector when the main carriage and a sub-carriage are connected to each other.

Thereafter, the position detector 16 is alternately passed by the black and white portions of the first detector reading part 15*a*, so that the light emitted from the light emitting part 16*a* is repeatedly detected or not detected by the light receiving part 16*b* until the main carriage 1 is connected to the sub-carriage 2 as illustrated in FIG. 6. Although pulses are generated before and after the second detector reading part 15*b* passes through the position detector 16, a detector, not shown, that detects a pulse width is provided to discriminate those pulses from pulses generated by the first detector reading part 15*a*.

The number of pulses generated by the first detector reading part 15*a* is counted each time the main carriage 1 and the sub-carriage 2 are connected to each other, and this pulse count is compared to a reference pulse number, that is, the number of pulses for a state in which the main carriage 1 and the sub-carriage 2 are considered to be properly connected to each other. Such an arrangement provides for precise positioning, and accordingly, even when a point of connection between the main carriage 1 and the sub-carriage 2 is shifted in directions indicated by the double-headed arrow A in FIG. 6, it is determined whether or not the position of the sub-carriage 2 relative to the main carriage 1 is appropriate based on a difference in the number of pulses detected and the reference pulse number.

When the light emitted from the light emitting part 16*a* is transmitted throughout the second detector reading part 15*b*, that is, when the second detector reading part 15*b* is composed only of a white portion as illustrated in FIG. 4A, the light receiving part 16*b* can detect the light while the second detector reading part 15*b* passes through the position detector 16. Because the position detector 16 starts detecting the number of pulses when the first black portion of the first detector reading part 15*a* or the rightmost edge of the first detector reading part 15*a* illustrated in FIG. 4A passes through the position detector 16, that is, when the light receiving part 16*b* goes off for the first time, displacement of a point of connection between the main carriage 1 and the sub-carriage 2 can be detected in the similar manner as described above.

When the number of pulses counted is larger than the reference pulse number, it can be detected that the point of connection between the main carriage 1 and the sub-carriage 2 is shifted in a direction of connection of the main carriage 1 and the sub-carriage 2. By contrast, when the number of pulses counted is smaller than the reference pulse number, it can be detected that the point of connection between the main carriage 1 and the sub-carriage 2 is shifted in a direction of separation of the main carriage 1 and the sub-carriage 2. Accordingly, even in a case in which a position to mount the positioning guide 15 slightly differs in the main scanning direction for each image forming apparatus, a difference between the number of pulses counted and the reference pulse number for each image forming apparatus is detected so that accuracy in the position to mount the positioning guide 15 does not cause problems.

Figure 8A:
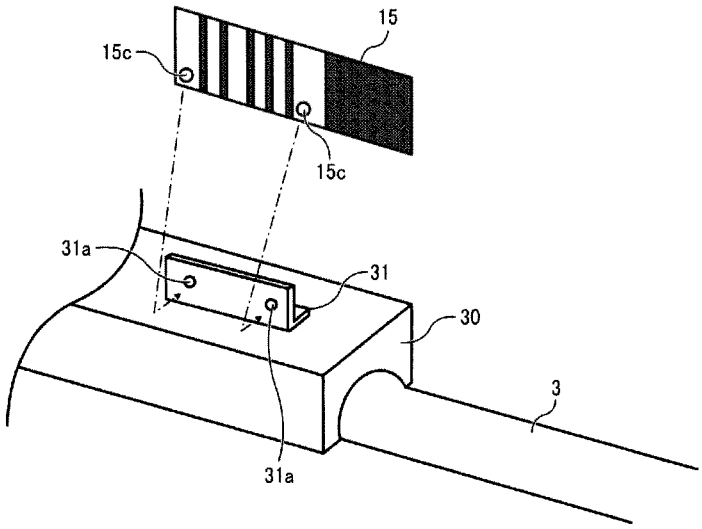
FIGS. 8A and 8B are views respectively illustrating mounting of the positioning guide to a mounting part.
Figure 8B:
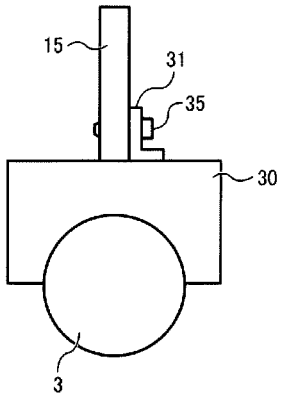

A description is now given of installation of the positioning guide 15 to the main carriage 1. The positioning guide 15 is mounted via a mounting member 31 to a mounting part 30 provided to the main carriage 1. Specifically, the mounting part 30 is provided to the main carriage 1 at a position corresponding to an upper part of the guide rod 3 in the direction of gravity. FIGS. 8A and 8B are views respectively illustrating how to mount the positioning guide 15 to the mounting part 30.

As illustrated in FIG. 8A, the mounting member 31 formed of an L-shaped metal sheet is provided on the mounting part 30. It is to be noted that a shape of the mounting member 31 and a way to install the mounting member 31 to the mounting part 30 are not particularly limited. A screw 35 inserted into a hole 31*a* of the mounting member 31 and a hole 15*c* of the positioning guide 15 is fasten to fix the positioning guide 15 to the mounting part 30 via the mounting member 31 as illustrated in FIG. 8B.

Accordingly, a surface of the mounting member 31 and a part of a surface of the positioning guide 15 contact together to fix the positioning guide 15 to the mounting member 31. The positioning guide 15 includes, for example, a linear scale, and has a thin member. Because the positioning guide 15 is fixed to the main carriage 1 on the guide rod 3 through the mounting part 30 and the mounting member 31 as described above, the positioning guide 15 is not bent in the sub-scanning direction during scanning of the main carriage 1.

It is to be noted that the way to mount the positioning guide 15 to the mounting part 30 is not particularly limited to the example illustrated in FIGS. 8A and 8B. Alternatively, the positioning guide 15 may be bonded to the mounting member 31 with an adhesive agent or the like. Further alternatively, an insertion hole may be provided to the mounting part 30 such that the positioning guide 15 is inserted into the insertion hole to be fixed to the mounting part 30. In such a case, the mounting member 31 is not necessary. Moreover, the mounting part 30 and the mounting member 31 may be integrally formed. When the positioning guide 15 has sufficient rigidity, the mounting part 30 may be fixed only to the second detector reading part 15*b*. Alternatively, the mounting part 30 may be fixed throughout the positioning guide 15 in the main scanning direction. In such a case, the positioning guide 15 is more easily guided by the opening 22 of the sub-carriage 2 compared to a case in which the mounting part 30 is fixed only to a part of the positioning guide 15.

As illustrated in FIG. 7, a predetermined distance h is provided between an upper edge of the mounting member 31 and a bottom surface 33 of the sub-carriage 2 when the main carriage 1 and the sub-carriage 2 are connected to each other. Accordingly, the mounting member 31 and the sub-carriage 2 do not interfere with each other when the main carriage 1 and the sub-carriage 2 are connected to each other.

Examples of the position detector 16 include, but are not limited to, a detector that can read the positioning guide 15 such as an encoder sensor, a reflective sensor, and a transmission sensor. The position detector 16 is connected to the control unit 50 (FIG. 1A) including a CPU or the like, and the control unit 50 controls the position of the carriages 1 and 2 based on a value output from the position detector 16.

It is preferable that the joint assembly 17 be provided to portions of the main carriage 1 and the sub-carriage 2 in the sub-scanning direction between the carriages 1 and 2 in the main scanning direction.

Figure 9:
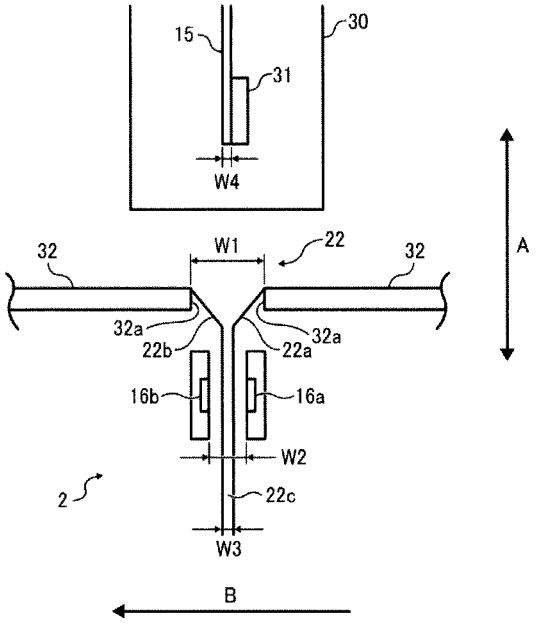
FIG. 9 is a plan view illustrating relative positions of the positioning guide and a guide part.
Figure 10:
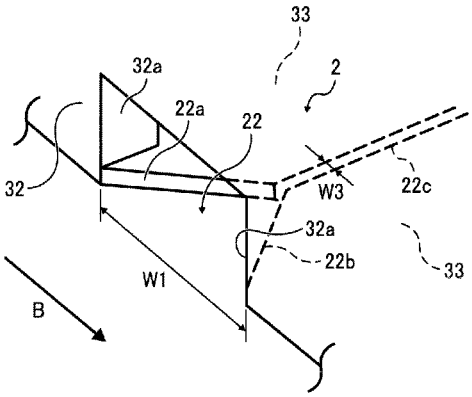
FIG. 10 is an enlarged perspective view illustrating an example of a configuration of an opening of the guide part illustrated in FIG. 9.

A description is now given of the guide part of the sub-carriage 2. FIG. 9 is a plan view illustrating relative positions of the positioning guide 15 and the opening 22 of the guide part. FIG. 10 is an enlarged perspective view illustrating an example of a configuration around the opening 22 illustrated in FIG. 9.

The guide part passes through the sub-carriage 2 from upstream to downstream in a direction of insertion of the positioning guide 15, and includes the opening 22, tapered surfaces 22*a* and 22*b*, and an insertion guide 22*c*.

The opening 22 has a width W1, and is formed by the bottom surface 33 of the sub-carriage 2 and inner walls 32*a* of lateral surfaces 32 of the sub-carriage 2. The tapered surfaces 22*a* and 22*b* are formed by the bottom surface 33 of the sub-carriage 2, and are tilted inward from upstream to downstream in the direction of insertion of the positioning guide 15. Accordingly, even when the positioning guide 15 is inserted off toward the direction indicated by the arrow B in FIGS. 9 and 10, the tapered surfaces 22*a* and 22*b* can guide the positioning guide 15 to the center, that is, the insertion guide 22*c*. At this time, a portion of the positioning guide 15 contacting the tapered surfaces 22*a* and 22*b* is positioned lower than the position detector 16 (or the light emitting part 16*a* and the light receiving part 16*b*), so that the position detector 16 can accurately detect the positioning guide 15 even if the positioning guide 15 slides against the tapered surfaces 22*a* and 22*b*.

The insertion guide 22*c* is formed continuously from a downstream edge of each of the tapered surfaces 22*a* and 22*b* on the bottom surface 33 of the sub-carriage 2 in the direction of insertion of the positioning guide 15. The insertion guide 22*c* is formed along each of surfaces of the light emitting part 16*a* and the light receiving part 16*b* so that the positioning guide 15 is guided to face the light emitting part 16*a* and the light receiving part 16*b* when inserted. When a width W3 of the insertion guide 22*c* is equal to a thickness W4 of the positioning guide 15, a distance between the positioning guide 15 and each of the light emitting part 16*a* and the light receiving part 16*b* is kept constant, thereby reliably detecting the position of the main carriage 1. Alternatively, the width W3 of the insertion guide 22*c* may be larger than the thickness W4 of the positioning guide 15 as long as the position detector 16 can accurately detect the positioning guide 15. As a result, load generated when the main carriage 1 and the sub-carriage 2 are connected to each other is reduced, thereby reducing stress on the positioning guide 15.

As described above, the guide part of the sub-carriage 2 and the positioning guide 15 are designed to satisfy the following relation of: W4≤W3<W2<W1, where W1 is a width of the opening 22, W2 is a width between the light emitting part 16*a* and the light receiving part 16*b*, W3 is a width of the insertion guide 22*c*, and W4 is a thickness of the positioning guide 15.

The guide part of the sub-carriage 2 having the above-described configuration can reliably guide the positioning guide 15 to the position detector 16 therethrough even when the positioning guide 15 is bent in the sub-scanning direction compared to a guide part into which the positioning guide 15 can be merely inserted.

Figure 11:
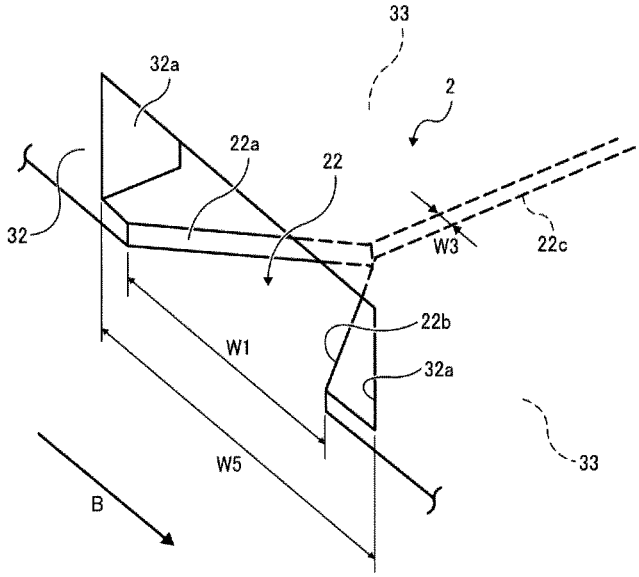
FIG. 11 is an enlarged perspective view illustrating another example of a configuration of the opening of the guide part.

Although each of the bottom surface 33 and the inner walls 32*a* of the sub-carriage 2 has the same width W1 at an entrance of the opening 22 in FIG. 10, alternatively, the inner walls 32*a* may have a width W5 that is larger than the width W1 of the bottom surface 33 as illustrated in FIG. 11. Accordingly, interference with the inner walls 32*a* can be prevented even when the positioning guide 15 positioned above an upper portion of the bottom surface 33 is bent larger than the width W1 in the direction indicated by the arrow B in FIG. 11 at upstream edges of the tapered surfaces 22*a* and 22*b* in the direction of insertion of the positioning guide 15. As a result, the positioning guide 15 can be more smoothly inserted into the guide part of the sub-carriage 2.

Figure 12:
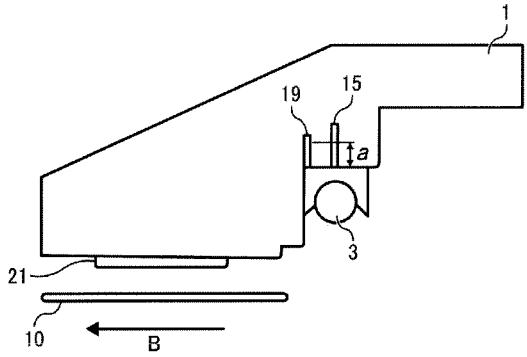
FIG. 12 is a side view illustrating an example of the main carriage having a partition.

It is preferable that a partition 19 be provided to the main carriage 1 as illustrated in FIG. 12. FIG. 12 is a side view illustrating an example of the main carriage 1 having the partition 19 formed of a shielding member.

Specifically, FIG. 12 illustrates relative positions of the positioning guide 15, a nozzle surface 21 of the recording heads 7, and the printed portion of the sheet 10. It is preferable that the positioning guide 15 be positioned higher than the nozzle surface 21 of the recording heads 7 so that blots on the positioning guide 15 caused by ink scattering or ink mist can be prevented.

Further, the partition 19 having a height equal to or higher than a height a of the positioning guide 15 illustrated in FIG. 12 is provided between the nozzle surface 21 of the recording heads 7 or the printed portion of the sheet 10 and the positioning guide 15 in the sub-scanning direction. Accordingly, blots on the positioning guide 15 can be prevented. Because blots on the second detector reading part 15*b* of the positioning guide 15 do not affect positional detection accuracy, the partition 19 is preferably provided at least a position corresponding to the first detector reading part 15*a* of the positioning guide 15 in a width direction of the main carriage 1.

Although a configuration of the partition 19 is not particularly limited, the partition 19 may be formed of a rib-shaped shielding material such as metal sheet or mylar (registered trademark) plastic. In a case in which the positioning guide 15 is designed to be inserted into the sub-carriage 2, an opening that can guide the partition 19 inside the sub-carriage 2 in the similar manner as the positioning guide 15 is additionally provided to the sub-carriage 2.

The positioning guide 15 is provided above the nozzle surface 21 of the recording heads 7 as described above to prevent adverse effects caused by ink mist during printing. As a result, irregular reading of the position detector 16 can be prevented and durability of the positioning guide 15 can be improved. Further, the partition 19 can prevent blots on the positioning guide 15 and the position detector 16 caused by ink scattering or ink mist, thereby improving durability of the positioning guide 15 and the position detector 16.

Figure 13:
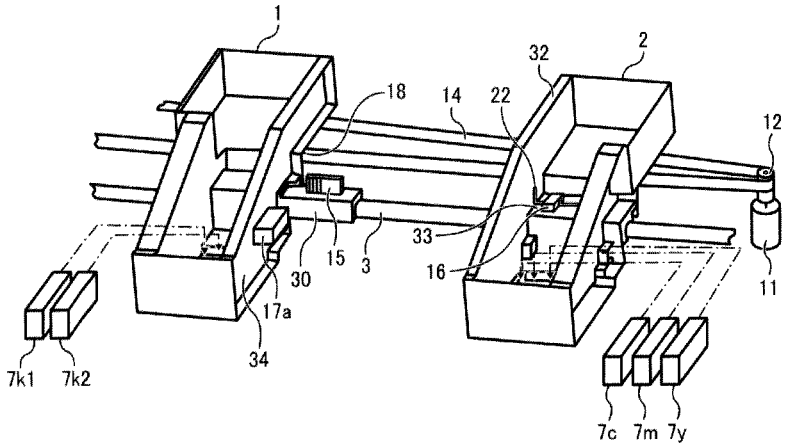
FIG. 13 is a perspective view illustrating a configuration of a main scanning unit according to a second illustrative embodiment.
Figure 14:
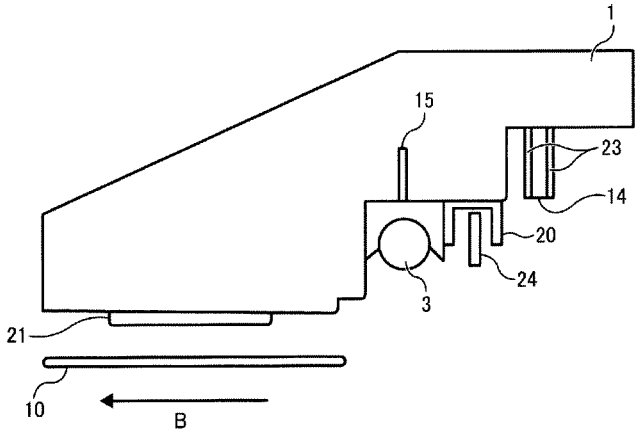
FIG. 14 is a side view illustrating an example of a configuration of a main carriage illustrated in FIG. 13.

A description is now given of a configuration of the main scanning unit according to a second illustrative embodiment. FIG. 13 is a perspective view illustrating a configuration of the main scanning unit according to the second illustrative embodiment. FIG. 14 is a side view illustrating an example of a configuration of the main carriage 1 illustrated in FIG. 13. Specifically, relative positions of the positioning guide 15, the nozzle surface 21 of the recording heads 7, and the printed portion of the sheet 10 are illustrated in FIG. 14.

The belt member 14 serving as a drive transmission member formed of a timing belt or a wire is connected to the drive source connection unit 18 of the main carriage 1 so that movement of the main carriage 1 is controlled by the drive motor 11. The belt member 14 is held by a belt holding member 23 provided to the main carriage 1. The sub-carriage 2 may include the drive source connection unit 18 such that movement of the sub-carriage 2 may be controlled by the drive motor 11 in the similar manner as the main carriage 1, or the sub-carriage 2 may be controlled by a driving force transmitted from the main carriage 1 through the joint assembly 17.

The image forming apparatus 5 further includes an encoder sheet 24 extended between lateral plates of the main carriage 1, not shown, along the main scanning direction, and an encoder detector 20 provided to sandwich the encoder sheet 24. Accordingly, a position of the main carriage 1 or the main carriage 1 connected to the sub-carriage 2 in the main scanning direction can be detected using the encoder sheet 24 and the encoder detector 20. Further, the number of pulses and a clock frequency of the control unit 50 (FIG. 1A), respectively detected, are compared to each other so that a speed of the main carriage 1 or the main carriage 1 connected to the sub-carriage 2 is calculated.

The encoder detector 20 provided to the main carriage 1 reads the encoder sheet 24 to detect the position of the main carriage 1 in the main scanning direction and to control timing to discharge ink droplets. Accordingly, a pulse having a wide width generated before and after the second detector reading part 15*b* passes through the position detector 16 in FIG. 4B is calculated from a distance travelled by the main carriage 1 obtained by detecting the encoder sheet 24 and a time when the wide pulse is turned on and off. It is to be noted that the sub-carriage 2 may include the encoder detector 20 to detect the position of the sub-carriage 2 in the main scanning direction and to control timing to discharge ink droplets.

The main carriage 1 includes the drive source connection unit 18 for scanning and the encoder detector 20 for detecting the position of the main carriage 1 and for controlling timing to discharge ink droplets as described above to achieve a reliable operation thereof, thereby reducing deterioration of image quality. Further, stability of operation of the sub-carriage 2 is improved. It is to be noted that methods for detecting the position of the main carriage 1 and/or the sub-carriage 2 in the main scanning direction are not particularly limited, and a well-known or new method may be used.

In the image forming apparatus 5 according to illustrative embodiments, first, a number of pulses of the positioning guide 15 read by the position detector 16 when the main carriage 1 and the sub-carriage 2 are properly connected to each other is stored as the reference pulse number in a storage unit such as a RAM. Subsequently, the position detector 16 reads a number of pulses of the positioning guide 15 each time the main carriage 1 and the sub-carriage 2 are connected to or disconnected from each other. The number of pulses thus read is compared with the reference pulse number to detect a shift in the position between the main carriage 1 and the sub-carriage 2 when the number of pulses and the reference pulse number are different.

When a shift from the reference position is detected, the shift can be corrected at a time when ink droplets are discharged from the recording heads 7. For example, in a case in which it is detected that a distance between the main carriage 1 and the sub-carriage 2 in the contacted state is larger than the reference position, the shift in the position between the main carriage 1 and the sub-carriage 2 can be corrected by, for example, delaying the time to discharge ink droplets from the recording heads 7 of the sub-carriage 2. Accordingly, irregular printing can be prevented.

A message indicating that the shift in the position between the main carriage 1 and the sub-carriage 2 is detected may be output to output means such as an operation panel, not shown, included in the image forming apparatus 5. It is to be noted that examples of the output means are not particularly limited to the operation panel, and may include a sound generator or the like that generates a warning beep or an error message. Further, it is preferable that display of the message and generation of the warning beep be performed together. Accordingly, a user is notified of irregular connection between the main carriage 1 and the sub-carriage 2 and can adjust the position of the main carriage 1 and the sub-carriage 2 using adjusting means or the like. Further, when a foreign substance sandwiched between the main carriage 1 and the sub-carriage 2 is visually confirmed by the user, the user can remove the foreign substance.

Color of ink droplets and the number of the recording heads 7 installed in the main carriage 1 and the sub-carriage 2 are not particularly limited. However, when at least a recording head for discharging black ink droplets is provided to the main carriage 1 and at least a recording head for discharging color ink droplets, that is, ink droplets of magenta, cyan, and yellow, is provided to the sub-carriage 2, the reference position can be clear because a single color acts as a reference. Accordingly, a shift in each color can be easily detected, thereby improving printing accuracy.

Although the single sub-carriage 2 is provided for the single main carriage 1 according to the foregoing illustrative embodiments, the number of the sub-carriage 2 is not limited to one, and multiple sub-carriages 2 may be provided for the single main carriage 1 described above. For example, in a case in which two sub-carriages 2 are provided with the main carriage 1 interposed therebetween, the positioning guide 15 is provided respectively to lateral surfaces of the main carriage 1 to respectively obtain the reference positions from the main carriage 1. In a case in which the multiple sub-carriages 2 are provided at one side of the main carriage 1, the positioning guide 15 is provided to one of the sub-carriage 2 interposed between the other sub-carriage 2 and the main carriage 1 in the same manner as the main carriage 1 described above. For example, in a case in which an additional sub-carriage 2 is provided on the right of the sub-carriage 2 in the example illustrated in FIG. 2, the positioning guide 15 is provided to a right lateral surface of the sub-carriage 2 interposed between the main carriage 1 and the additional sub-carriage 2. Configurations similar to those described above are applicable to a case in which more than three sub-carriages 2 are provided.

As can be appreciated by those skilled in the art, numerous additional modifications and variations are possible in light of the above teachings. It is therefore to be understood that within the scope of the appended claims, the disclosure of this patent specification may be practiced otherwise than as specifically described herein. For example, elements and/or features of different illustrative embodiments may be combined with each other and/or substituted for each other within the scope of this disclosure and appended claims.

For example, the foregoing illustrative embodiments are also applicable to a device that accurately performs positioning of an operating body relative to a body having a straight line motion on the same axis.

This patent specification is based on Japanese Patent Application Nos. 2009-121956, filed on May 20, 2009, and 2010-049033, filed on Mar. 5, 2010, both in the Japan Patent Office, each of which is hereby incorporated herein by reference in its entirety.

What is claimed is:

1. An image forming apparatus comprising:

a main carriage to move and scan in a main scanning direction, the main carriage including at least one recording head mounted thereon;

a sub-carriage connectable to the main carriage to move and scan in the main scanning direction together with the main carriage, the sub-carriage including one or more recording heads mounted thereon, wherein the main carriage including the at least one recording head mounted thereon and the sub-carriage including the one or more recording heads mounted thereon are connected to each other;

a positioning guide provided on one of the main carriage and the sub-carriage;

a position detector provided on the other one of the main carriage and sub-carriage, wherein the position detector reads the positioning guide as the main carriage and the sub-carriage are connected to, or disconnected from, each other to detect relative positions of the main carriage and the sub-carriage in states in which the main carriage and the sub-carriage are connected to, or disconnected from, each other, respectively; and a control unit connected to the position detector to control the main carriage and the sub-carriage based on data from the position detector indicating the relative positions of the main carriage and the sub-carriage, and to control liquid droplet ejection by the recording head on the main carriage and liquid droplet ejection by said one or more recording heads, wherein the control unit determines whether the relative position detected by the position detector is shifted from a reference position in a connected state of the main carriage and the sub-carriage, and when the relative position is shifted from the reference relative position, the control unit determines an amount of the shift, and wherein the control unit corrects timing to discharge liquid droplets from said recording head on the main carriage or from said one or more recording heads on the sub-carriage, based on the amount of the shift when the relative position is shifted from the reference relative position.

2. The image forming apparatus according to claim 1, wherein:

the positioning guide protrudes in a direction perpendicular to a surface of one of the main carriage and the sub-carriage having the positioning guide, the surface contacting one of the main carriage and the sub-carriage having the position detector; and the positioning guide is guided inside one of the main carriage and the sub-carriage having the position detector from a guide part provided to one of the main carriage and the sub-carriage having the position detector as the main carriage and the sub-carriage connect to each other.

3. The image forming apparatus according to claim 1, wherein the positioning guide and the position detector are respectively provided at positions corresponding to an upper portion of a guide member that slidaby holds the main carriage.

4. The image forming apparatus according to claim 1, wherein the positioning guide is provided parallel to a longitudinal direction of the guide member that slidably holds the main carriage.

5. The image forming apparatus according to claim 1, wherein the positioning guide comprises:

a first detector reading part having multiple slits read by the position detector; and a second detector reading part, the second detector reading part having either no slits or slits set at a pitch different from the pitch of the multiple slits of the first detector reading part.

6. The image forming apparatus according to claim 5, wherein:

the main carriage comprises an encoder detector to detect a position of the main carriage or the main carriage connected to the sub-carriage in the main scanning direction; and whether the position detector is positioned at the first detector reading part or the second detector reading part is determined based on a result detected by the encoder detector and a result obtained by the position detector.

7. The image forming apparatus according to claim 1, wherein:

the positioning guide is mounted to one of the main carriage and the sub-carriage through a mounting member; and a surface of the mounting member contacts at least a part of the positioning guide.

8. The image forming apparatus according to claim 7, further comprising a predetermined gap maintained between an upper edge of the mounting member and a bottom surface of one of the main carriage and the sub-carriage having the position detector as the main carriage and the sub-carriage connect to each other.

9. The image forming apparatus according to claim 2, wherein the guide part comprises:

an opening; and tapered surfaces at a mouth of the opening, a width of the opening narrowing downstream a direction of insertion of the positioning guide.

10. The image forming apparatus according to claim 9, wherein:

the guide part guides the positioning guide from the opening to an insertion guide narrowed by the tapered surfaces; and a relation of $W4 \leq W3 < W2 < W1$ is satisfied, where W1 is a width of the opening, W2 is a distance between a light emitting part and a light receiving part of the position detector, W3 is a width of the insertion guide, and W4 is a thickness of the positioning guide.

11. The image forming apparatus according to claim 1, wherein:

one of the main carriage and the sub-carriage includes the positioning guide at a position higher than a nozzle surface of a recording head; and a partition is provided between the nozzle surface and the positioning guide in a sub-scanning direction.

12. The image forming apparatus according to claim 1, wherein:

the main carriage includes a recording head that discharges black ink droplets; and the sub-carriage includes a recording head that discharges color ink droplets.

13. The image forming apparatus according to claim 1, wherein:

the position detector is provided inside the other one of the main carriage and the sub-carriage, the positioning guide is read by the position detector at a portion inside the other one of the main carriage and the sub-carriage having the position detector, while being guided inside the other one of the main carriage and the sub-carriage having the position detector through an opening portion formed in the other of the main carriage and the sub-carriage having the position detector, so that the position detector reads the positioning guide to detect relative positions of the main carriage and the sub-carriage.

* * * * *